United States Patent [19]

Iwamoto

[11] Patent Number: 4,954,063

[45] Date of Patent: Sep. 4, 1990

[54] INJECTION PRESSURE CONTROL APPARATUS FOR A DIE CAST MACHINE AND AN INJECTION MOLD MACHINE

[75] Inventor: Norihiro Iwamoto, Zama, Japan

[73] Assignee: Toshiba Kikai Kabushiki Kaisha, Tokyo, Japan

[21] Appl. No.: 330,287

[22] Filed: Mar. 29, 1989

[30] Foreign Application Priority Data

Mar. 29, 1988 [JP] Japan ..... 63-41738[U]

[51] Int. Cl.[5] ..... B29C 45/82

[52] U.S. Cl. ..... 425/149; 164/151; 164/154; 264/40.1; 425/156; 425/170

[58] Field of Search ..... 425/149, 170, 169, 156; 164/154, 151, 150; 264/40.1, 40.3

[56] References Cited

U.S. PATENT DOCUMENTS

| | | | |
|---|---|---|---|
| 3,941,534 | 3/1976 | Hunkar | 425/149 |
| 4,161,380 | 7/1979 | Bishop | 425/149 |
| 4,207,047 | 6/1980 | Kolb et al. | 425/149 |
| 4,208,176 | 7/1980 | Salerno | 425/149 |
| 4,426,341 | 1/1984 | Tsuzuker et al. | 425/170 |
| 4,708,620 | 11/1987 | Brugger | 425/170 |
| 4,744,743 | 5/1988 | Puschel et al. | 425/170 |

FOREIGN PATENT DOCUMENTS 61-237616 10/1986 Japan ..... 425/149

*Primary Examiner*—Jay H. Woo
*Assistant Examiner*—Khanh P. Nguyen
*Attorney, Agent, or Firm*—Cushman, Darby & Cushman

[57] ABSTRACT

This invention relates to an injection pressure control apparatus for a die cast machine and an injection mold machine. In the injection pressure control apparatus, it detects whether the pressure increase state of the instance when the pressure of the injection cylinder is increased through a pressure increasing circuit is normal or not. When detecting the above state, the pressure change obtained at the instance when the pressure increasing circuit is operated is detected between two points, of which it is determined whether the time spent therebetween is within an allowable time or not and the result is indicated. Moreover, the pressure detected after the pressure increasing circuit was operated and a predetermined period of time has passed is determined whether it is within a predetermined allowable range or not and the result thereof is indicated. Further, in the injection pressure control apparatus for the injection mold machine, it is deteted whether the detected pressure value at the instance when the pressure of the injection cylinder is increased and a predetermined measurement command signal is given is within an allowable range or not and the result thereof is indicated.

5 Claims, 4 Drawing Sheets

INJECTION PRESSURE CONTROL APPARATUS FOR A DIE CAST MACHINE AND AN INJECTION MOLD MACHINE

BACKGROUND OF THE INVENTION

1. Field of the Invention

The present invention relates to an injection pressure control apparatus for a die cast machine and an injection mold machine, and more detail, an apparatus for controlling whether the operational status of the oil pressure circuit of an injection device is proper.

2. Description of the Related Art

In a die cast machine, an injection has been carried out in such a manner that an injection plunger drive speed is changed from low to high by the function of a pressure increase circuit when injecting the molten metal in the mold cavity, to avoid enfolding air into the molten metal filled in the injection sleeve. It is also necessary to control the injection pressure precisely as a factor in making the quality of the die cast products stable. Accordingly, it is quite important to check the state of this injection pressure in order to produce die cast products having superior quality while avoiding many defective products.

In order to check the state of the injection pressure, the operational state of the pressure increase circuit cam be monitored, for instance, to detect the pressure change condition of an oil pressure circuit.

However, in the conventional die cast machine, since no such a pressure measuring apparatus which can detect the pressure change condition mentioned above is provided it is not possible to detect the change in the oil pressure control state of an injection cylinder when the oil pressure circuit comes into the abnormal state.

Accordingly, it has been impossible to avoid the problem of manufacturing many defective products, when the abnormal state is generated.

Further, the injection pressure through the process of injection by the injection mold machine is normally maintained at a low value at first, but gradually increases proportionately as the mold cavity is filled with molten resin. Accordingly, in the normal operation of the injection mold machine the increasing change of the pressure constantly appears.

However, in a multi-cavity mold or multi-gate mold, if some of the gates are clogged up, the flowing velocity of the molten resin which runs through the remaining gates increases to generate an excessive pressure which causes defective moldings.

Therefore, in the injection mold machine, it is important for manufacturing moldings of a stable quality to detect and maintain the proper injection pressure.

SUMMARY OF THE INVENTION

An object of the present invention is to provide an injection pressure control apparatus which can transmit information promptly that the injection pressure has become abnormal by detecting the injection pressure change of a die cast machine or an injection mold machine, and avoid manufacturing defective moldings, and which has a simplified construction and is compact in size as a whole.

To this end, an injection pressure control apparatus of a die cast machine according to the present invention comprises:

a pressure detecting part connected to an oil pressure circuit of an injection cylinder, means for setting the first pressure value to be set based on a pressure value obtained when a pressure of said injection cylinder is increased and a second pressure value to be increased by a predetermined value greater than the first pressure value, an operation device including clock means which clocks the time duration from when the pressure value detected by the pressure detecting part exceeds the first pressure value to when said detected pressure value reaches the second value, and means for comparing and processing whether said time duration clocked by the clock means is within the predetermined time or not, an indicator means indicating the compared and processed result in the operation device.

Further, another preferable modification of the injection pressure control apparatus of a die cast machine of the present invention comprises;

a pressure detecting part connected to an oil pressure circuit of an injection cylinder, an operation device having means for comparing whether the pressure to be detected after the pressure of said injection cylinder being increased is within an allowable range or not, and means for indicating the compared result Further, an injection pressure control apparatus for the injection mold machine according to the present invention comprises:

a pressure detecting part connected to an oil pressure circuit of an injection cylinder, an operation device determining whether a detected pressure is within a predetermined allowable range when a prescribed measurement command signal is supplied in accordance with the pressure increase of the injection cylinder, means for setting upper and lower limit values of the allowable range, and an indicator means including an alarm device to generate an alarm when the detected pressure is out of the allowable range.

DETAILED DESCRIPTION OF THE PREFERRED EMBODIMENT

Hereinafter, embodiments of the present invention will be explained in detail based on the attached drawings.

Figure 1:
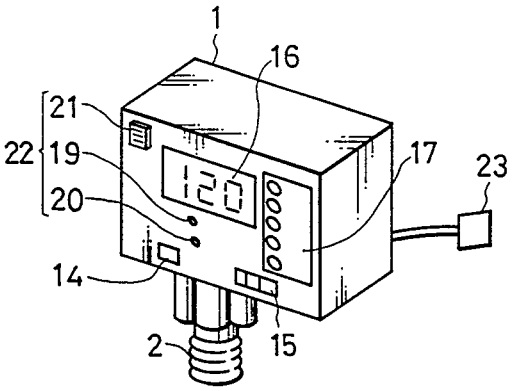
FIG. 1 is an external appearance of an injection pressure control apparatus.

FIG. 1 shows the external appearance of an injection pressure control apparatus. On one side of a case 1 formed in a box shape as a whole, a fixing cylinder 2 to be connected by a screw to an oil circuit of an injection device (not shown) is provided.

On one end of the fixing cylinder 2 located in the case 1, a diaphragm 3 which is formed integrally with the fixing cylinder 2 and constitutes a pressure receiving part is formed, and on the central part thereof in the axial direction, a hole 4 is formed to communicate with the oil pressure circuit.

Figure 2:
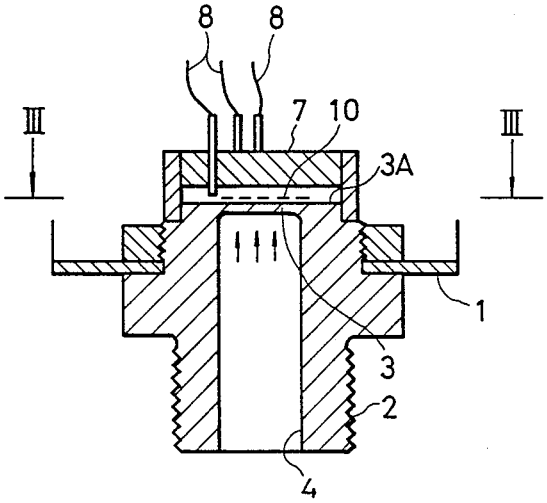
FIG. 2 is a partially sectional view of FIG. 1.
Figure 3:
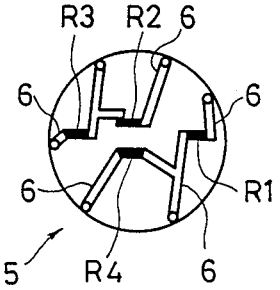
FIG. 3 is a sectional view along the line III—III in FIG. 2.

The fixing cylinder 2 and the diaphragm 3 are made of stainless steel, and on the upper surface 3A of the diaphragm 3 in FIG. 2, a silicon film for insulating between layers is formed after mirror polishing being processed as well as in IC manufacturing techniques. Further, on the film a christalline silicon film is formed, then through a photoetching process, a distortion gauge 5 having pattern resistors R1, R2, R3 and R4 as shown in FIG. 3 is formed, the surface of which is protected with a passivation film. By these elements, i.e. the diaphragm 3 and the distortion gauge 5, a semiconductor pressure detecting part 10 is constituted.

Figure 4:
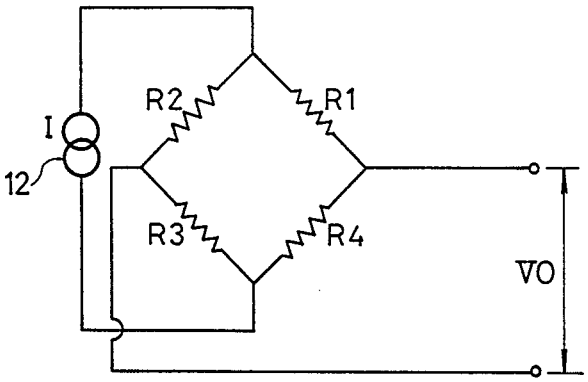
FIG. 4 is a bridge circuit of a pressure detecting part.

Moreover, the resistors R1–R4 form a bridge circuit through electrodes 6 as shown in FIG. 4, and these electrodes 6 are connected with an A/D converter 11 through leads 8 supported by seal cap 7.

Further, a reference numeral 12 in FIG. 4 shows a constant electric source which supplies an output voltage as VO.

Figure 5:
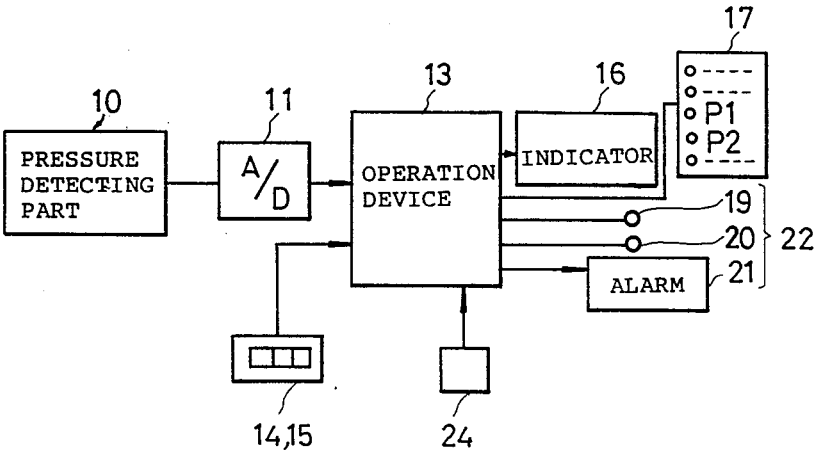
FIG. 5 is a block diagram of the injection pressure control apparatus.

The A/D converter 11 converts the analogue output voltage VO of the pressure detecting part 10 to a digital signal, which is supplied to the next operation device 13 as shown in FIG. 5.

The operation device 13 has a function the memorization of the first pressure value, which is a proper pressure when a pressure increasing circuit to displace rapidly the injection plunger of the injection device is operated and the second pressure value to be determined based on the proper maximum pressure value after the pressure increases. Further, the operation device 13 is comprises a clock means which generates a clock pulse when the detected pressure value of said pressure detecting part exceeds the first pressure value under operating of the pressure increasing circuit. The clock pulse is stopped when the detected pressure value reaches the second pressure value. The time duration for the detected pressure value to increase from the first pressure value to the second pressure value is measured, and comparing and processing means compares whether the measured time duration obtained thereby is within a predetermined allowable time range or not and supplies the result thereof.

The operation device 13 is connected with a mode change switch 14 to select a measurement mode and a preset mode, which is adapted to be supplied with a measurement starting signal when the measurement mode is selected. When the preset mode is selected, it is adapted to be supplied with the signal which sets the predetermined first and second pressure values and a prescribed time etc. In this case, it is possible to supply the setting pressure value and so forth into the operation device 13 by the setting button 15 forming a setting means.

Further, the operation device 13 is provided with an indicator 16 on which the measured pressure value, the measured time, preset pressure value and time are indicated, and the indication of the indicator 16 is also indicated by an indication panel 17 having a LEDs device. The color differentiated LED 19 and 20, which show whether the compared and processed result of the detected pressure in the operation device 13 is normal or not, are connected with the operation device 13 to which an alarm 21 is connect. The alarm comprises a buzzer and so forth to be operated when some abnormality is detected. Hereby, an indication means 22 is constituted by the LEDs 19, 20 and the alarm 21.

Further, a reference numeral 23 in FIG. 1 shows an electric source connector which is connected to an external electric source 24 (see FIG. 5).

Hereinafter, the function of the present embodiment will be explained referring to FIGS. 6 and 7.

In an initial setting process, the preset mode is selected by the preset switch 14. By means of the setting button 15, the first pressure value P1, the second pressure value P2 and the allowable time TRA are preset. In one embodiment, P1 is set at 108 $Kg/cm^2$, which is 80% of 135 $Kg/cm^2$, the pressure P1M of the change point M when the pressure increase circuit begins to operate. P2 is set at 269 $Kg/cm^2$, which is 80% of 336 $Kg/cm^2$, the maximum pressure P2 after the pressure has increased. Further, the allowable time TRA is set from the oil pressure increase time when the oil pressure circuit operates normally.

Successively, after completing those presetting operations and changing the mode change switch 14 to the measurement mode, the injection device is driven.

Figure 6:
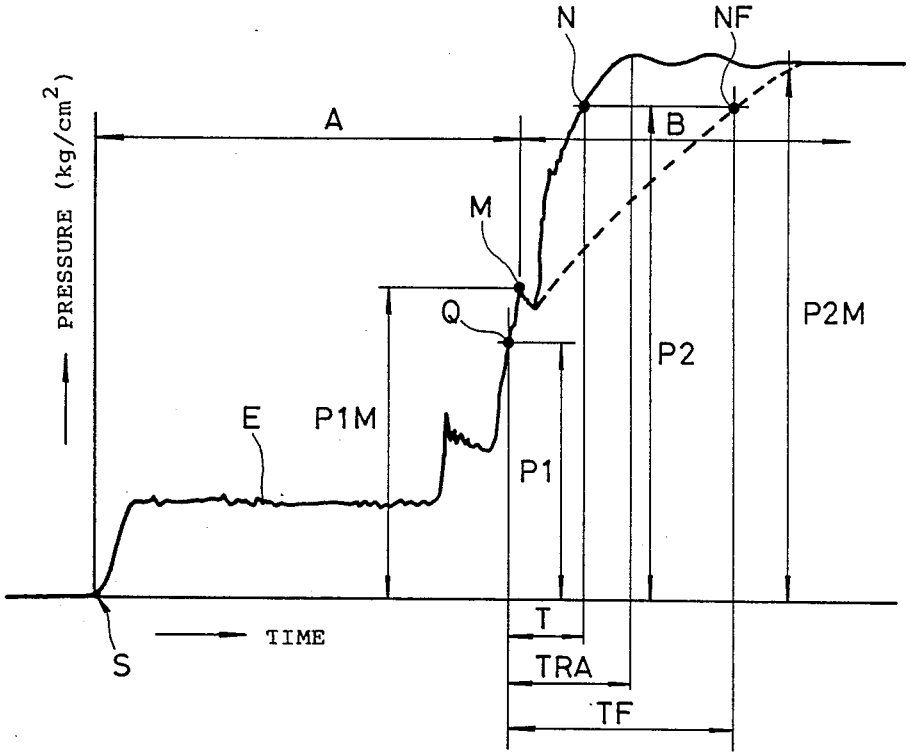
FIG. 6 is an oscillograph showing the pressure change.
Figure 7:
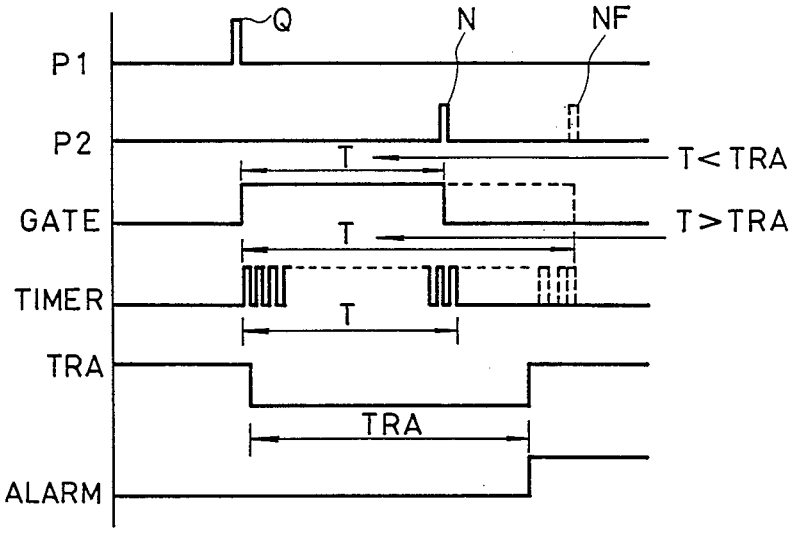
FIG. 7 is a time chart.

Now, assuming that in FIG. 6 the drive operation of the injection device takes place at S point, the output signal from the pressure detecting part 10 is successively taken in the operation device 13, and the change of pressure of the oil pressure circuit is detected as shown at E in FIG. 6. Then, when the operation device 13 detects that the detected pressure value exceeds the first pressure value P1, at Q point corresponding to said pressure value P1, the pulse signal for time measurement is generated and synchronously with that, a gate circuit, not shown, is opened and a clock pulse is output.

Further, when the operation device 13 detects that the detected pressure increases the second pressure value P2, at N point corresponding to the pressure value P2, a pulse signal is generated, the gate circuit is closed and the output of the clock pulse is stopped, whereby the measured time T obtained on the basis of the numbers of the count of the clock pulse in the meantime is indicated on the indicator 16 and simultaneously the operation device 13 compares whether measured time T is within the allowable time TRA. If the measured time T is within the TRA, on the presumption that the oil pressure circuit is operating normally, the LED 19 is lit, in green for example.

On the other hand, if the oil pressure change occurs as shown in a dotted line in FIG. 6, the measured time TF up to the point NF corresponding to the second pressure value P2M exceeds the allowable time TRA, so that the LED 20 is lit in red for example, and the operation device 13 supplies a signal for generating an alarm and operates the alarm 21 by means of a buzzer and so forth.

According to the above embodiment, the following effects are expected.

Because the apparatus of the present invention is constituted in such a manner that the first pressure value and the second pressure value, which specify two points of the pressure change at the instance when the pressure increase circuit of the injection device is operated, are provided, and the time interval between the pressure detected by part 10 exceeding the first pressure value and reaching the second pressure value is compared with an allowable time to determine whether it is within the allowable time. The result thereof is indicated, so that it becomes possible to rapidly inform an operator when in case that an abnormality occurs in the oil pressure circuit and also to stop the operation of the apparatus at once and take necessary measures such as maintenance or checking, to avoid further occurrences of defective moldings.

In addition to the above, as to the first pressure value, the second pressure value and the allowable time, the proper values and so forth can be determined statistically based on data obtained experimentally, so that it is easy to set an appropriate value under various molding conditions and to attain a highly precise pressure control.

Further, the apparatus as a whole, since it has the structure in which the pressure detecting part 10 and the operation device 13 and so forth are incorporated in the case 1, is quite compact, so that it is applicable to the conventional injection device quite easily merely by connecting it with the oil pressure circuit.

Moreover, although the first pressure value and the second pressure value in the above embodiment are set as 80% of the pressure value of the instance when the pressure increase circuit is in operation and 80% of the maximum pressure value thereof respectively, the present invention shall not be restricted to these values and rather can be changed in accordance with the molding conditions and so forth.

Further, in the above embodiment, although it is constituted in such a manner that it makes use of the preset allowable time in the occasion where the operation device 13 would compare and proceed, the present invention shall not be restricted to this and may compare and process without making use of the allowable time.

In this case, it is also possible to compare and process by supplying the measurement starting command corresponding to the timing, which is predetermined in such a manner that the detecting pressure would have belonged within such an allowable time to be preset, if the oil pressure circuit is assumed to be normal, as being comparatively narrowed by the second pressure value P2 and the higher pressure value which is obtained by making the first pressure value set higher than the pressure value P1 in the above embodiment.

Figure 8:
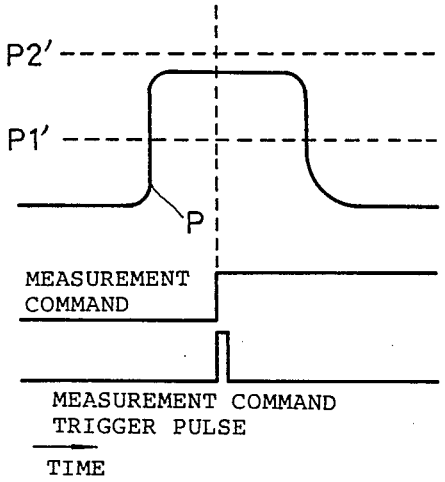
FIG. 8 is a graph showing the relation between the injection pressure change of an injection mold machine and the timing of a measurement command timing.

Further, the injection pressure control apparatus of the injection mold machine, as shown in FIG. 8, can be constituted such that the allowable range of the pressure is set by the low value P1' and the upper value P2'. The normal or abnormal is detected by determining whether the pressure detected when a predetermined trigger pulse signal for measurement command is supplied, is within the allowable range.

As explained above, according to the present invention, an injection pressure control apparatus can be provided, in which, even if the change of injection pressure in the die cast machine or the injection mold machine becomes abnormal, it can be promptly detected and operator informed to avoid the occurrence of defective moldings and the structure is simple and compact as a whole.

What is claimed is:

1. An injection pressure control apparatus for a die cast machine comprising:

a pressure detecting part connected to an oil pressure circuit of an injection cylinder, means for setting a first pressure value to be set based on a pressure value obtained when a pressure of said injection cylinder is increased and a second pressure value to be increased by a predetermined value more than the first pressure value, an operation device including clock means which clocks a time duration from when a pressure value detected by the pressure detecting part exceeds the first pressure value to when said detected pressure value reaches to the second value, and means for comparing and processing whether said time duration clocked by the clock means is within a desired time or not, an indicator means indicating the compared and processed result in the operation device.

2. An apparatus as defined in claim 1, wherein an output signal of said pressure detecting part is an analogue signal and said analogue signal is supplied in the operation device through an analog-digital converter.

3. An apparatus as defined in claim 1 wherein said operation device is connected with a setting means for setting the first pressure value and the second pressure value in accordance with a molding condition.

4. An apparatus as defined in claim 1, wherein said indicator means includes an indicator and an alarm device, which lights in a desired manner and generates an alarm respectively when the compared and processed result is decided abnormal.

5. An apparatus as defined in claim 1, wherein said pressure detecting part, said operation device and said indicator means are incorporated in a single case.

* * * * *